US009624635B2

(12) United States Patent
Al Bizri et al.

(10) Patent No.: US 9,624,635 B2
(45) Date of Patent: Apr. 18, 2017

(54) DEVICE AND PROCESS OF SNOW REMOVAL

(71) Applicants: COMPAGNIE MARITIME D'EXPERTISES, Marseilles (FR); ECODENEIGE, Marseilles (FR)

(72) Inventors: Hassan Al Bizri, Cabries (FR); François Dousteyssier, Marseilles (FR); Christophe Micoli, Marseilles (FR)

(73) Assignee: Ecodeneige, Marseilles (FR)

( * ) Notice: Subject to any disclaimer, the term of this patent is extended or adjusted under 35 U.S.C. 154(b) by 0 days.

(21) Appl. No.: 14/905,977

(22) PCT Filed: Jul. 16, 2014

(86) PCT No.: PCT/FR2014/051825
§ 371 (c)(1),
(2) Date: Jan. 19, 2016

(87) PCT Pub. No.: WO2015/007991
PCT Pub. Date: Jan. 22, 2015

(65) Prior Publication Data

US 2016/0153159 A1 Jun. 2, 2016

(30) Foreign Application Priority Data

Jul. 19, 2013 (FR) ..... 13 57115

(51) Int. Cl.

| | |
|---|---|
| ***B30B 9/12*** | (2006.01) |
| ***E01H 5/12*** | (2006.01) |
| ***B30B 9/26*** | (2006.01) |
| ***B30B 9/32*** | (2006.01) |
| ***E01H 5/10*** | (2006.01) |

(Continued)

(52) U.S. Cl.
CPC ..... *E01H 5/12* (2013.01); *B02C 23/18* (2013.01); *B30B 9/12* (2013.01); *B30B 9/26* (2013.01); *B30B 15/32* (2013.01); *E01H 5/102* (2013.01)

(58) Field of Classification Search
CPC .. B30B 13/00; B30B 9/12; B30B 9/06; B30B 9/26; B30B 9/267; B30B 11/24; B30B 15/32; E01H 5/00; E01H 5/10; E01H 5/102; E01H 5/104; E01H 5/106; E01H 5/108; E01H 5/12; E01C 19/05; B02C 23/18; B02C 23/20
See application file for complete search history.

(56) References Cited

U.S. PATENT DOCUMENTS

| | | | | |
|---|---|---|---|---|
| 540,026 A | | 5/1895 | Piatti | |
| 4,506,656 A | * | 3/1985 | Baasch | E01H 5/00 126/343.5 R |
| 4,697,572 A | | 10/1987 | James | |

(Continued)

FOREIGN PATENT DOCUMENTS

WO 2012038595 A1 3/2012

*Primary Examiner* — Jimmy T Nguyen
(74) *Attorney, Agent, or Firm* — Bookoff McAndrews, PLLC

(57) ABSTRACT

The device includes a first reservoir equipped with a mobile dynamic compacting device, water injection nozzles above and below chopping and/or mixing devices capable of forcing the snow downwards and ultrasound generating devices positioned below the water injection nozzles. The first reservoir is connected to a storage basin with two fluid transfer lines.

20 Claims, 6 Drawing Sheets

(51) Int. Cl.
*B02C 23/18* (2006.01)
*B30B 15/32* (2006.01)

(56) References Cited

U.S. PATENT DOCUMENTS

| | | | | |
|---|---|---|---|---|
| 5,266,220 | A * | 11/1993 | Hammond | E01H 5/102 126/343.5 R |
| 6,223,742 | B1 * | 5/2001 | Macameau | E01C 19/05 126/343.5 R |
| 6,736,129 | B1 * | 5/2004 | Smith | E01H 5/102 126/343.5 R |
| 2008/0178866 | A1 | 7/2008 | Davies | |
| 2014/0020672 | A1 * | 1/2014 | Vero | E01H 5/10 126/271.1 |

* cited by examiner

DEVICE AND PROCESS OF SNOW REMOVAL

BACKGROUND OF THE INVENTION (1) Field of the Invention

The present invention concerns a device and method for the volume reduction and fluidising of snow, to evacuate snow accumulated on roadways in public places or at industrial and airport sites.

The present invention relates to the general field of the volume reduction of snow subsequent to storms in places of large surface area and where clearing and return to operating service must be very rapidly obtained.

The places concerned are chiefly airports and aerodromes but also all surfaces in public places which require the clearing of accumulated snow so that normal working conditions can be resumed.

Airports, inter alia, have surface areas in the order of several million m2 which represents several hundred thousand m3 of snow to be evacuated before return to normal operating conditions. Evacuation must be carried out within a very short time and can be envisaged in 1 to 3 days. This is currently achieved using heavy construction machinery such as diggers and dump trucks sometimes requiring the transfer of snow over long distances.

One of the problems that arises is the volume of snow involved requiring the snow to be stored at a place far from the clearing site. In particular the removed snow must not be stockpiled on the edge of runways to prevent the accumulation of water which will turn to mud causing a hazard for aircraft. A second problem concerns the maximum permissible height on the side of runways which must be heeded for airport operation. This permissible height is not compatible with the volumes of snow under consideration under snowy weather conditions.

On account of the volume of snow involved, the amount of machinery and the number of loading/transport/tipping cycles at an adapted storage place are relatively high and fast snow-clearing methods prove to be extremely costly.

A further problem is related to the fact that evacuated snow contains pollutants such as fuel as well as trash or various solid objects such as pieces of tyres or various dirt items.

The problems of snow-clearing also affect winter tourist sites such as ski resorts and industrial sites such as oil installations and gas production installations in northern or polar regions where weather conditions can lead to the formation of snow drifts on installations and buildings making them impracticable and/or inoperable and even inaccessible in some cases.

At the present time, in practice, these constraints are dealt with by melting the snow with change of physical state, from ice state to liquid state by phase change, via heating which entails high energy consumption due to phase change, notably involving energy from fossil sources such as gas, coal and petroleum leading to strong emissions of greenhouse gas which place in doubt operations conducted in urban areas or polar regions on account of the damage to the ecosystem caused by these snow melting treatments.

(2) Description of the Related Art

In particular it is known from US 540 026, US 2008/0178866 or WO/038595, to store and heat snow using different ordinary heating means in a surface enclosure, and to recover the water.

Document U.S. Pat. No. 4,697,572 describes a hopper equipped with snow comminution means combined with water injection means, the liquid being evacuated to a sewer line.

The device in U.S. Pat. No. 4,697,572 uses large quantities of mains water for the mechanical obtaining of a mixture. The mains water is consumed in large quantities and discharged in the form of a water/snow slurry. This entails an expensive waste of mains water calories.

The disadvantages of current methods are due to the fact that the volumes of snow involved require storage in large-volume enclosures or tanks, hence positioned at a distance from the clearing site, whilst at the same time on account of the volume of snow involved the machinery required and number of loading/transport/tipping cycles between the clearing site and the storage place are relatively high, which means that available snow clearing methods are relatively lengthy and costly.

It is therefore the objective of the present invention to provide snow clearing devices and methods allowing facilitated transport and fastest possible reduction of snow volume for evacuation thereof, so as to limit extremely costly operating stoppages at low cost. More particularly, the objective is to allow a reduction in volume of snow accumulated on large surface areas which must be made operational very rapidly and to evacuate and/or store the snow in liquid form in reservoirs of limited volume so that they can be easily installed in the vicinity of sites at risk to limit the distance to be traveled by snow-clearing vehicles.

SUMMARY OF THE INVENTION

For this purpose the present invention provides a snow volume-reducing and fluidising device comprising:

- a first fixed reservoir (acting as "fluidising tank"), equipped with means to fluidise and reduce the volume of snow; and
- at least one second reservoir forming a storage basin of larger volume than the first reservoir, the volume of said storage basin being at least 20 times preferably at least 100 times the volume of the first reservoir, and said storage basin being at least partly filled with water at ambient temperature, preferably at least 20% of its volume being filled with water; and
- at least a first fluid transfer line between an evacuation orifice at the lower end of said first fluidising reservoir and said storage basin; and
- at least one second transfer line between the storage basin and said first reservoir, preferably from the bottom of said storage basin;
- said fluidising means comprising:
  - snow compacting means comprising mobile dynamic compacting means; and
  - mechanical break-up means via chopping and/or mixing arranged underneath said compacting means and capable of causing the snow to be forced downwards; and
  - water injection means, preferably comprising water spray nozzles inside and/or above the first reservoir supplied by water derived from the storage basin via said second transfer line, said water injection means being positioned at least above the chopping and mixing means, preferably also below said chopping and/or mixing means; and
- ultrasound generating means comprising ultrasound-emitting devices supported by a rigid structure inside the first reservoir and arranged below said chopping and/or mixing means and below said water injection nozzles.

Preferably said first reservoir is partly pre-filled with water in the lower part of the first reservoir up to above said ultrasound emitters and below said mechanical break-up means. The ultrasounds can therefore be more efficiently diffused in water rather than air.

More particularly said rigid structure is a lattice structure defining orifices allowing the passing of fluidised snow and the flowing thereof down towards the bottom of the first reservoir, said rigid structure extending substantially over the entire horizontal cross section of the first reservoir and supporting a plurality of ultrasound emitters distributed at several points.

Still further particularly, said ultrasound emitters are in the form of cylindrical bars, preferably 10 to 50 in number, secured on top of the solid parts of said rigid structure and distributed over said rigid structure so that said ultrasounds are diffused in substantially homogeneous manner over the entire cross-section of said first reservoir, at least in a lower part of the first reservoir that is preferably pre-filled with water.

This arrangement and homogeneous diffusion of the ultrasound emitters inside the first reservoir allows increased efficiency of the ultrasounds generated directly within the water/snow mixture. The break-up means using ultrasound are thereby optimised in terms of required power and/or rapidity of snow fluidisation, the snow being made more easily and more quickly transferable.

According to the present invention, the snow is fluidised in said first reservoir to a homogeneous, broken down, fluidised water/snow mixture that can be pumped or mechanically transferred to said storage basin of larger size inside which complete natural melting of the snow is obtained at ambient temperature without any energy being supplied by the machine.

The ultrasounds break up the crystal aggregates forming the snow and facilitate fluidising of the snow without heating and without conducting any change of state, leading to a reduction in the volume thereof and its easy transport. There is possible melting of that part of the snow immersed in the lower part of the first reservoir pre-filled with water.

According to the present invention the snow is not melted but brought to a pumpable or mechanically transferable homogenous paste using the combination of means applying ultrasound in particular to break up the snow, the result being a considerable reduction in energy consumption since the calories required for the changeover from solid state to liquid state are not needed inside the reservoir.

In addition, the method of the present invention does not consume any water but operates in a closed circuit with the storage basin and allows the recovery and treatment of water so that it can be used for other needs.

The device of the present invention is therefore more advantageous both in terms of energy consumption and in terms of water saving.

According to the present invention, the heating of water is therefore not necessary and is only applied to prevent freezing of nozzles or conduits or machinery parts under certain circumstances.

The combination of means involving the use of ultrasound and mixing allows breaking-up of the ice crystal aggregates forming the snow so that it can be fluidised without changing its physical state so that the overall energy consumption of the method according to the invention is at least 20 times lower than needed in prior art devices entailing heating of the snow.

Said chopping and/or mixing means and reducing and fluidising means are capable of fracturing blocks of ice or compacted snow and of breaking-up and homogenizing the snow so that it can be transferred via said first transfer line from the lower end of the reservoir towards the storage basin.

Said means to inject water at ambient temperature contribute towards fluidisation using energy derived from the storage basin through the supply of calories naturally contained in the ground. The system operates in a closed circuit without the supplying of energy by the machine other than a transfer pump.

The fact that the volume of the first reservoir is relatively limited, inside which the snow is fluidised before being transferred by pumping means towards said storage basin of larger volume and further distant from the snow-covered site, makes it possible for the first reservoir to be installed permanently at a relatively short distance from the site at risk.

In addition, according to the present invention, benefit is drawn from the fact that the treatment time to fluidise the snow in the first reservoir of relatively reduced size is compatible with the time for loading/transport/unloading by a relatively reduced number of dump trucks and/or standard size loading buckets.

Furthermore, since use is made of a separate first reservoir and storage basin, the first reservoir is used solely to fluidise the snow which melts naturally inside the storage basin of larger volume through the natural supply of energy from the ground and which can be installed at a further distance from the site, the mixture obtained in the first reservoir allowing easy transport over long distances via conduits and pumps.

More particularly, the holding capacity of the reservoir is several $m^3$ of snow, in particular 4 to 30 $m^3$ depending on the machine model and hence adapted as a function of site size and snow loading/unloading means, and in relation to the number of reservoirs according to the present invention.

It will be understood that the first reservoir receives the snow directly unloaded by dump trucks. It acts as buffer reservoir and comprises equipment to assist the downward movement of the snow, even for snow compaction and fluidisation via injection of water, mixing and forcing the snow downwards towards the bottom of the reservoir.

The lower part of the first reservoir is pre-filled with water towards which the snow is directed so that the mixture obtained can be pumped and sent towards the injection nozzles equipping the first reservoir and/or towards the storage basin, thereby providing the calories required to increase fluidisation of the snow. Also, ultrasounds are diffused more efficiently in water than in air.

A further advantage of the device is therefore also of environmental type since it allows water to be reused rather than lost as is explained below.

A further advantage, concerning energy this time, lies first in the fact that use is made of the calorific energy provided by the ground and made available via the water stored in the storage basin to melt the snow and fluidise agglomerate, and secondly in that the distances traveled by vehicles are shortened thereby reducing greenhouse gas.

In addition, one advantage of the device is that the on-site melting of snow is avoided which would generate highly wet and potentially muddy areas creating a traffic hazard.

The ultrasound generating means emit ultrasounds of at least 20 kHz, preferably 20 kHz to 1 MHz.

These ultrasound generating means as is known per se comprise generators to increase the frequency of the usual electric voltage which is 50 Hz up to a frequency of 20 kHz or higher, coupled to transducers also known as sonotrodes formed of one of more pairs of pre-stressed piezoceramics forming Langevin triplets which convert electric current to mechanical vibratory movement thereby generating ultrasound waves.

Preferably, the initial compacting by said mobile dynamic compacting means before mixing allows a reduction in the initial volume Vo of snow of at least 30% (V=70% of Vo) hence at least a 30% reduction in energy or time needed to fluidise the compacted snow with the ultrasound generating means (t=70% of to).

The combination of said mobile dynamic compacting means, of said water injection means and said chopping and mixing means therefore allows the volume of snow to be divided by a factor of at least 2 to 5, whilst said ultrasound generating means allow the snow to be fluidised into a homogenous mixture to allow rapid transport thereof via conduits and conventional pumping and transfer means.

More particularly, said mobile dynamic compacting means comprise pivoting plates, preferably openwork plates, the assembly of said plates substantially covering the entire surface of a horizontal cross-section of said first reservoir above said chopping and/or mixing means, said plates being secured to the side walls of the first reservoir and hinged in rotation relative to said side walls of said first reservoir along a horizontal rotation axis preferably assisted by hydraulic cylinders.

Snow contains 50 to 90% air, the openwork therefore allowing air to be evacuated and the snow to be pre-chopped when being compacted. More particularly, the perforations of said openwork plates form a comb or rake-like structure with solid parts at least 10 cm in width spaced by voids at least 10 cm in width.

Preferably, the first reservoir also comprises means for filtering solid objects contained in the snow, preferably a grid of mesh size at least 5 cm, arranged upstream of said evacuation orifice for the fluidised snow mixture in the lower part of the first reservoir, downstream of said ultrasound generating means, and means to evacuate said objects out of the first reservoir in particular towards an additional vat, preferably evacuation means of scraper type actuated by a hydraulic cylinder or Archimedes screw.

More particularly, the first reservoir, the injection nozzles and the transfer lines further comprise secondary heating means via Joule effect. According to the present invention, heating is applied solely to prevent freezing of the nozzles or conduits but it is not required to fluidise the snow; it is the use of the combination of means and in particular of the ultrasound which allows breaking-up of the snow-forming ice crystal aggregates.

More particularly, the constituent frame members of said lattice structure supporting the ultrasound emitters define a regular mesh size of 5 to 15 cm.

The ultrasound means allow transforming of the compacted snow to increase the fluidity thereof and allow easier transferring of the mixture obtained after ultrasound treatment in the conduits and evacuation and transfer means which transfer this mixture towards the storage basin via conduits having a cross-section at least 200 mm in diameter. This transfer action takes place through the transfer pump.

Advantageously the reservoir, in addition to said reservoir, comprises static compacting means whereby:

- its height is of larger dimension than its width; and
- its side walls comprise a part forming a funnel having a horizontal cross-section smaller than the upper opening, said funnel-forming part being arranged at least below said chopping and/or mixing means.

This is because underneath said chopping and/or mixing means the snow after break-up is reduced in volume.

More particularly, said mechanical means are chopping, mixing and forced movement means comprising toothed rotating discs and/or fingers in the form of angled blades mounted on at least one horizontal transverse shaft or drum and capable of breaking up and forcing downwards pieces of ice and/or compacted snow, preferably a plurality of parallel shafts so as to cover the entire horizontal cross-section of said first reservoir.

Preferably said first reservoir comprises or cooperates with dynamic means to evacuate the fluidised snow, at the lower end of the first reservoir, preferably a transfer pump and/or motorised worm screw, downstream of said evacuation orifice and below said filtering means and said ultrasound generating means.

More particularly, the first reservoir also comprises first fluidised snow transfer means comprising a first conduit and first fluid circulation pump from said first reservoir towards said storage basin, and second means to transfer water between said storage basin and water injection nozzles inside the first reservoir, comprising a second conduit and second fluid circulation pump.

Preferably, the first reservoir is an open-top tank with the lower part of the side walls partly buried in the ground, or said first reservoir is arranged on a truck or trailer.

In one non-preferred variant, said first reservoir is mounted and secured directly on a truck following the snow clearers which then tip the snow directly into the opening of the first reservoir.

Further preferably, the storage basin is an open basin with at least the lower part of the side walls partly buried in the ground. Otherwise the storage basin can be merely placed on the ground.

The present invention also provides a method for snow-clearing a site using a device of the invention, characterized in that it comprises the steps of:

- tipping snow into the first reservoir, preferably at a rate of 2 to 30 $m^3$/minute of snow; and
- actuating said chopping and/or mixing means, said water injection means, preferably said dynamic compacting means and ultrasound generating means; and
- evacuating fluidised snow from said evacuation orifice towards said storage basin, preferably at a rate of 2 to 30 $m^3$/minute of fluidised snow. It is then possible to provide for rotations of loading and unloading vehicles handling 20 to 30 $m^3$ every 1 to 3 minutes.

Finally, having regard to the volumes involved, the device can be equipped with hydraulic pumps and conduits allowing water to be transferred to an outflow point such as a river, lake or retention pond, after filtering.

The capacity of snow reduction, fluidisation, evacuation and storage is dependent on the surface area of the place to be equipped and type of snow, in particular the proportion of air contained therein namely in general 50 to 90% air as mentioned above. The number of devices to be installed is to be adapted on the basis of standard unit sizes of about 2 to 30 m3, and the number and size of reservoirs can be modulated as a function of the geometric constraints of the site. For example a storage basin can be used having a capacity of 20 m×30 m×4 m i.e. 2,400 m3.

When said first reservoir and/or said second reservoir are buried, the earth acts as heat exchanger so that the fluidised snow mixture transferred from the bottom of the first reservoir and/or the water transferred from the second reservoir are at a higher temperature than the outside temperature.

With said device operating in a closed loop, the invention also allows the adjoining of filtration modules to separate chemical and particle pollutants from the water contained in the storage basin, the objective being to make this water usable for green areas in warm weather for example or for use as cleaning and domestic water.

Preferably said first reservoir and said storage basin are partly pre-filled with water and preferably at least partly buried, and the water circulates in a closed circuit between said storage basin and said first reservoir, said storage basin comprising or cooperating with water filtration and circulation means allowing the stored water to be transferred to a water supply network or to the environment.

For example, if water networks or natural or created water reservoirs are present on site, the device(s) can be directly connected thereto.

The device and different steps of the method of the invention are determined by computer programme instructions and/or a programmable logic controller (PLC) with man-machine interface (MMI).

The invention therefore also concerns a computer programme on a data medium, this programme able to be implemented in a control module, this programme comprising instructions adapted to apply the steps of the method of the invention.

This programme can use any programming language, and may be in the form of a source code, object code or intermediate code between a source code and object code such as in a partly compiled form, or in any other desirable form. Also the data medium may be a transmissible medium such as an electrical or optical signal which can be conveyed via an electrical or optical cable, via radio or via other means towards a control room for remote alarm reporting and/or piloting.

Other characteristics and advantages of the present invention will become apparent from the description given below with reference to the appended drawings illustrating an example of embodiment thereof that is in no way limiting.

DETAILED DESCRIPTION OF THE INVENTION

Figure 1:
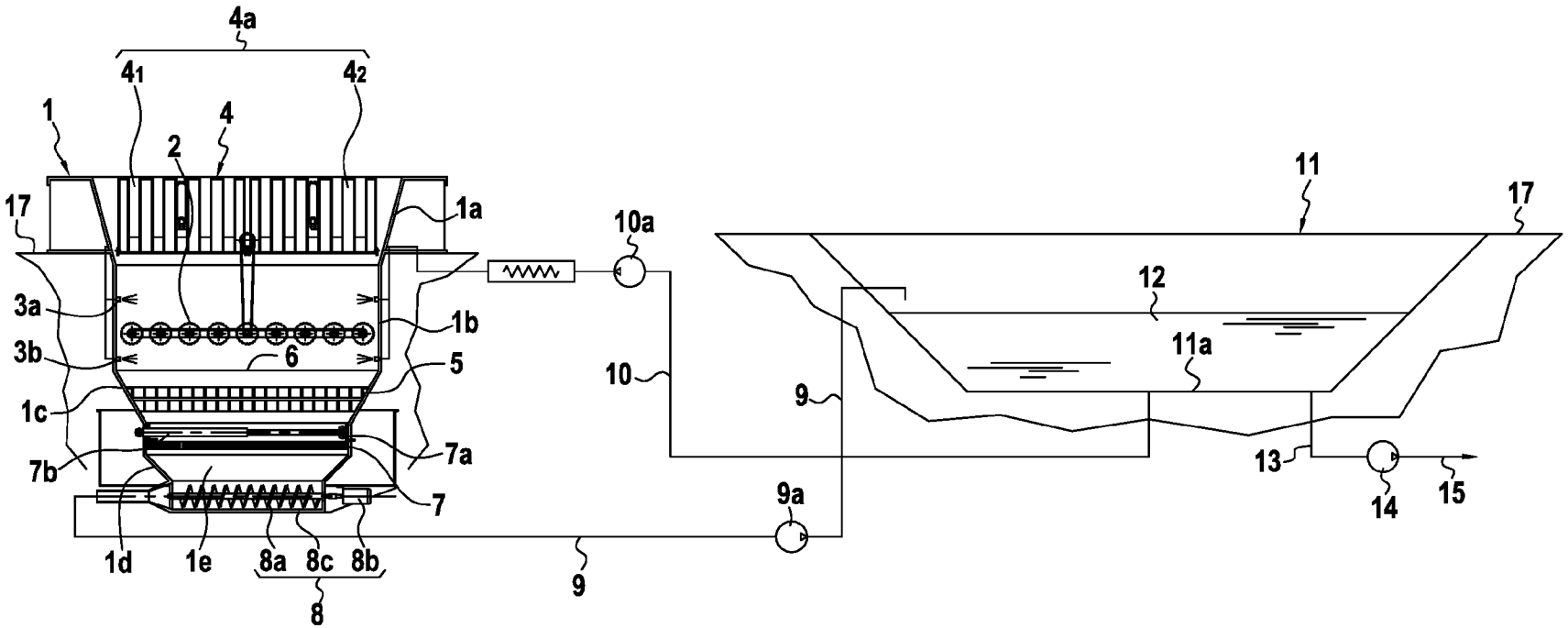
FIG. 1 is an overall illustration of the device with the reservoir 1 and storage basin 11 giving a vertical, longitudinal section view of the reservoir.
Figure 2:
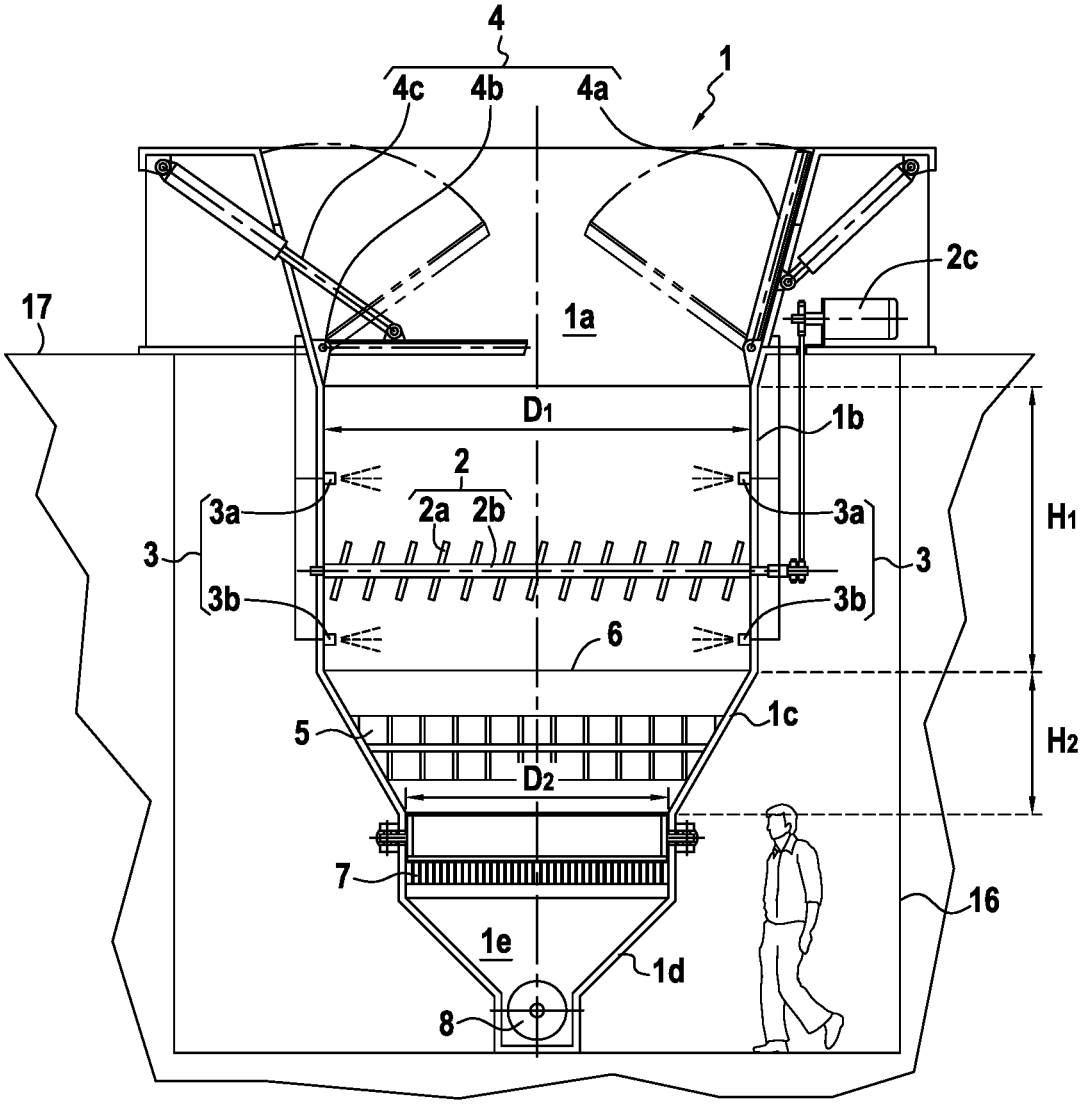
FIG. 2 is a vertical cross-sectional view of the reservoir in a buried pit.

FIG. 1 illustrates a device of the invention allowing a volume of snow to be reduced by fluidisation for easy evacuation thereof. The volume-reducing, fluidisation and storage device of the invention illustrated in the Figures comprises a first reservoir 1 arranged below ground level in a pit 17 which can be partly buried in the vicinity of the site to be cleared of snow, and connected to a second reservoir called storage basin 11 of larger volume and also preferably buried and located further away from the site to be cleared. The reservoir and storage basin are open at the top.

The first reservoir 1 comprises a horizontal cross-section of rectangular shape and has an upper part 1*a* with flared side walls including two parallel, opposite side walls equipped with compacting means 4. The compacting means are formed of two rectangular, openwork plates 4*a* each pivot-mounted on a horizontal shaft 4*b* arranged at one of said lateral walls and capable of being pivoted by a cylinder 4*c* between:

- a lower closed, substantially horizontal position in which the two openwork plates 4*a* substantially cover the entire surface of the horizontal cross-section of the first reservoir, said cylinder 4*c* being in extended position; and
- an open upper position in which the openwork plates 4*a* are substantially in vertical position against said side walls 1*a*. Initially, the openwork plates are therefore in the upper open position when a loader or dump truck (not illustrated) drops snow into the first reservoir. Then, at a first stage of the treatment method according to the invention the openwork plates are pivoted to lower position to compact the snow between said plates 4*a* and the mixing means 2 positioned underneath as described below. It is preferred here that the openwork plates 4*a* should not descend lower than the horizontal position to avoid excessive compacting of the snow and jamming actuation of the chopping and mixing means 2 described below.

The compacting means also contribute towards pushing the snow downwards in the first reservoir 1 in the direction of the chopping and mixing means 2.

Figure 3:
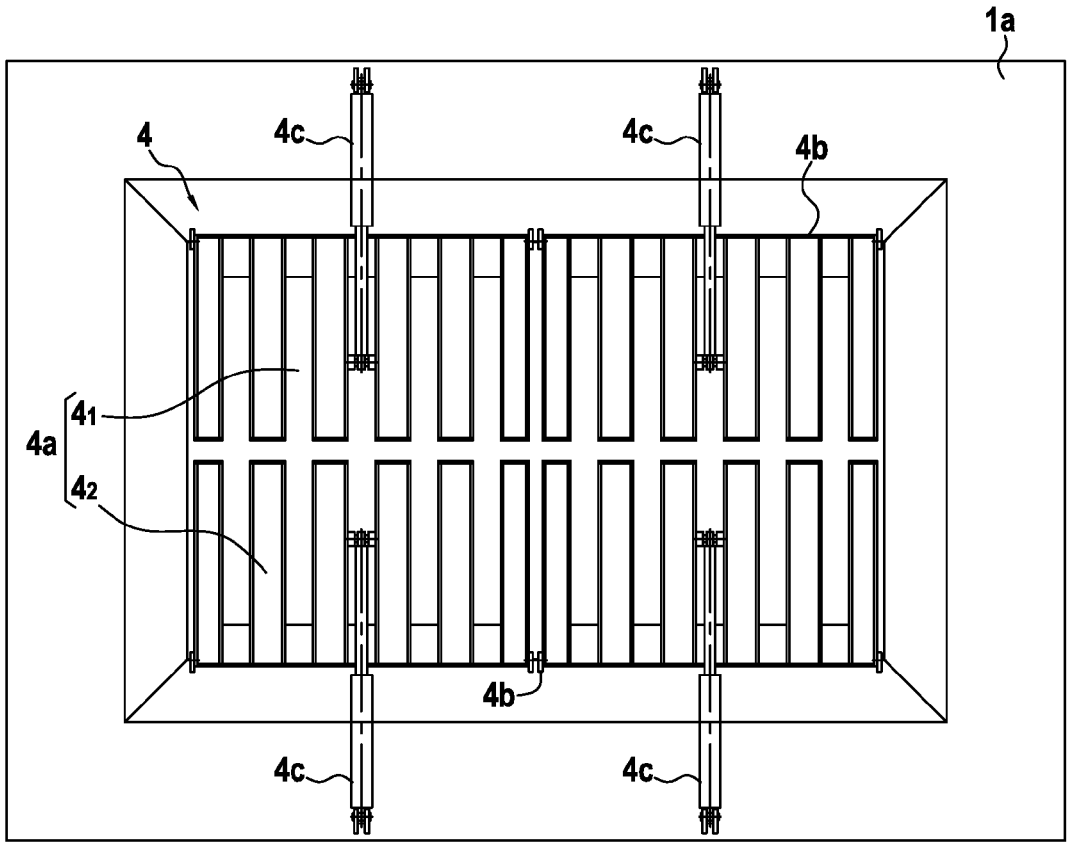
FIG. 3 is an overhead view of the reservoir showing the openwork compacting plates in bottom closed position.

In FIG. 3, the plates 4*a* are formed of parallel slats $\mathbf{4}_2$ separated by voids $\mathbf{4}_1$ forming combs or rakes.

The orifices $\mathbf{4}_1$ in the openwork plates 4 allow evacuation of the air contained in the snow at the time compacting. Compacting of the snow preferably allows a first volume reduction to be obtained of at least 30% (v=70% of v0). In addition a further objective of compacting is to optimise the efficacy of the snow break-up means via ultrasound treatment described below.

The compacted snow in the intermediate compartment 1*b* between the openwork plates 4*a* in lower position and the chopping and mixing means 2 (described below) is treated by injecting water at ambient temperature by the first water spray nozzles 3*a* mounted on the side walls of the intermediate part 1*b* of the reservoir. The water is drawn from the water 12 stored in the storage basin 11, the latter being initially filled with an amount that is at least 20%, here 50%, of its volume. The water 12 is pumped at the bottom 11*a* of the storage basin 11 and transferred via said second transfer line 10 and second circulation pump 10*a* to the spray nozzles 3*a* and 3*b*. The spray nozzles 3*a* and 3*b* allow sprinkling of the snow with water to contribute towards fluidisation thereof since the sprayed water is at ambient temperature. In this respect, it is pointed out that if the outside weather conditions are very cold and the surface of the basin 12 is frozen, the water underneath the surface is liquid and remains at a sufficient temperature to heat and start fluidising the snow. The water injected into the compacted snow therefore allows initial fluidisation.

The snow is then chopped and mixed by chopping and mixing means 2 comprising a plurality of chopping and mixing devices 2 arranged horizontally and parallel. Each chopping and mixing device 2 comprises a plurality of discs with toothed periphery and/or with fingers or projections in the form of blades 2*a*, tilted in relation to the vertical in a regularly spaced and parallel arrangement, and mounted around and along a horizontal shaft 2*b* able to be set in rotation by a motor 2*c*. The rotating toothed discs and/or blades 2*a* create the triple technical effect of chopping, mixing and forced downward movement of the compacted snow to a lower part 1*c* of the reservoir arranged below the chopping and mixing means 2.

In the lower part 1*c*, the side walls of the first reservoir are of pyramidal of funneled shape. At this level, the compacted snow has been partly fluidised and is in the form of a mixture. Any pieces of ice contained therein have been crushed and any blocks of highly compacted snow have been chopped. The chopped, mixed snow is also subjected to water injection treatment by second lower water spray nozzles 3*b* arranged underneath the chopping and mixing devices 2 and supplied by the same second conduit 10 and second pump 10*a*. With this fluidisation treatment the snow undergoes a volume reduction by a factor of at least 2 to 5 when it is useful to apply an additional compacting treatment resulting from the funnel shape of the reservoir side walls in said lower part 1*b*.

Figure 4:
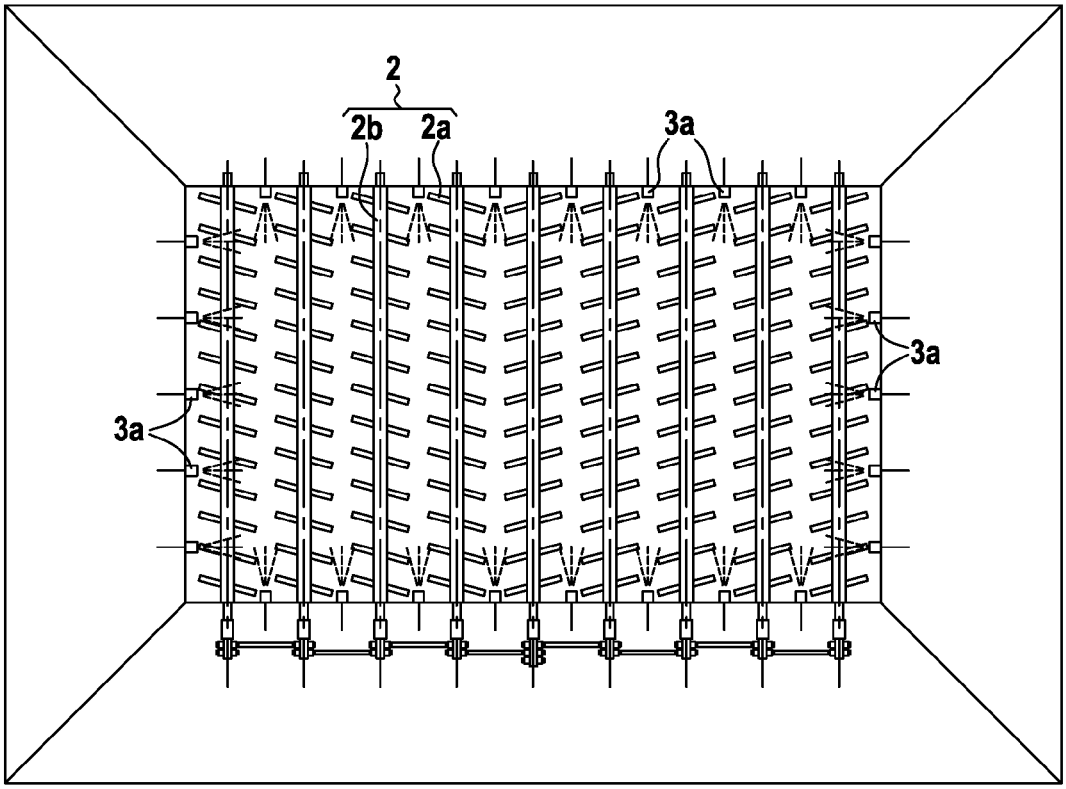
FIG. 4 is an overhead view of the assembly of chopping and mixing devices 2.

In FIG. 4, nine chopping and mixing devices 2 have been arranged 9 parallel and side by side so as substantially to cover the entire surface of a horizontal cross-section of the first reservoir, two successive devices being regularly spaced part with their rotation shaft rotating in reverse direction relative to the other.

In the lower part 1*c*, the snow is subjected to ultrasound treatment to complete snow break-up and fluidisation. This lower part 1*c* of the first reservoir is initially pre-filled with water and represents a volume of about 6 m3 for example. The surface 6 of the water being about 6 $m^2$ for example over a height H2 higher than 1 m due to the funnel shape of this lower part 1*c*.

Part 1*b* of the reservoir containing the chopping and mixing devices 2 and water injection nozzles 3 above the rigid structure 5, extends over a height H1 higher than H2.

Figure 5A:
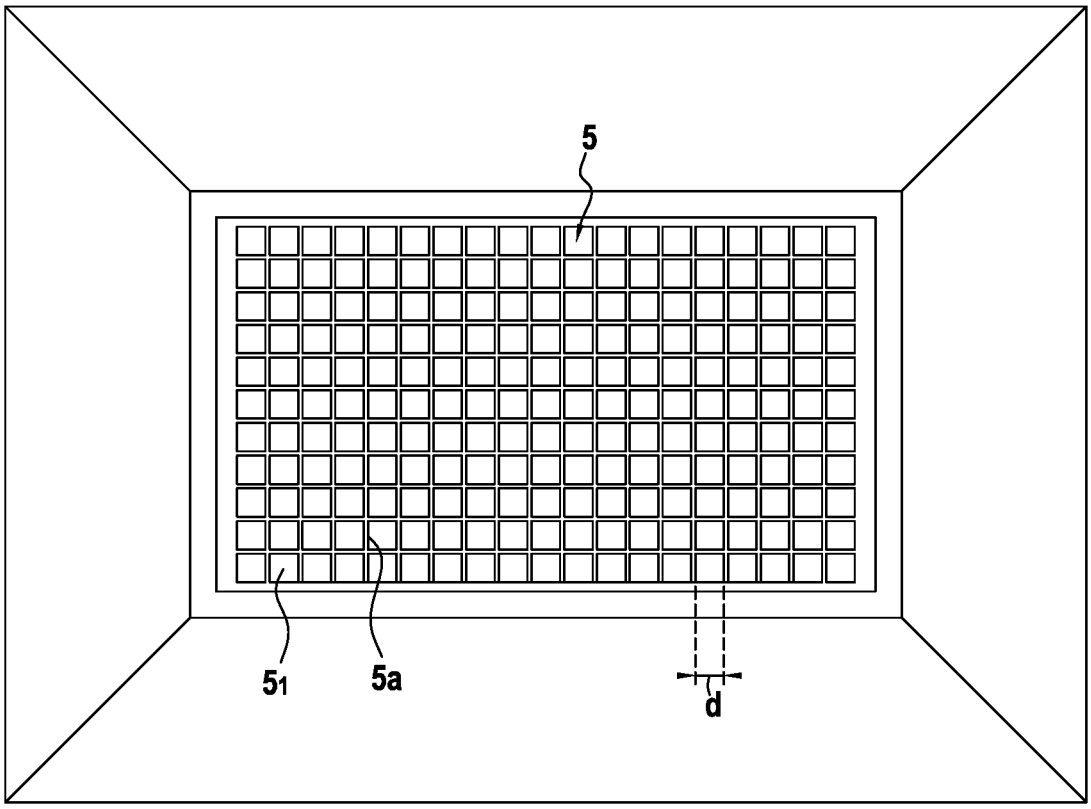
FIG. 5A is an overhead view of the first lattice structure 5 supporting the ultrasound generating means.
Figure 5B:
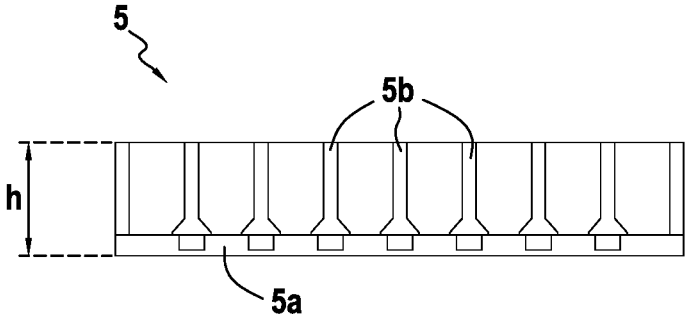
FIG. 5B is a vertical cross-sectional view of the first lattice structure 5 showing transducers 5*a* in homogeneous arrangement.

In FIGS. 5A and 5B, the ultrasound treatment means comprise a rigid lattice structure 5 formed by crossed profiles or rigid frame members 5*a* having a thickness and width of 5 to 10 cm on which ultrasound-emitting sonotrodes or transducers 5*b* are secured distributed at multiple points in the horizontal cross-section of the first reservoir. The meshing of the lattice structure 5 creates orifices $\mathbf{5}_1$ having sides d=5 to 25 cm, in particular d=10 to 20 cm, allowing the downward flow of the broken down water/snow mixture. The sonotrodes are in the form of substantially cylindrical bars of diameter about 5 to 10 cm and height of about 50 to 150 cm. Ultrasound emitters of this type in the form of bars are known to persons skilled in the art and commercially available. This embodiment is advantageous since it creates a vibrating contact surface and hence the generation of ultrasounds within the water/snow mixture in the first reservoir and substantially over the entire cross-section thereof. For example 20 to 40 ultrasound emitting bars 5*b* of this type of 20 kHz to 2 kW power are regularly distributed over the entire lattice structure 5*a*.

The initial pre-filling of the lower part 1*c* of the first reservoir with water allows said ultrasound-emitting bars to be fully immersed, in particular to promote diffusion of ultrasound waves within the entire water/snow mixture.

Figure 6:
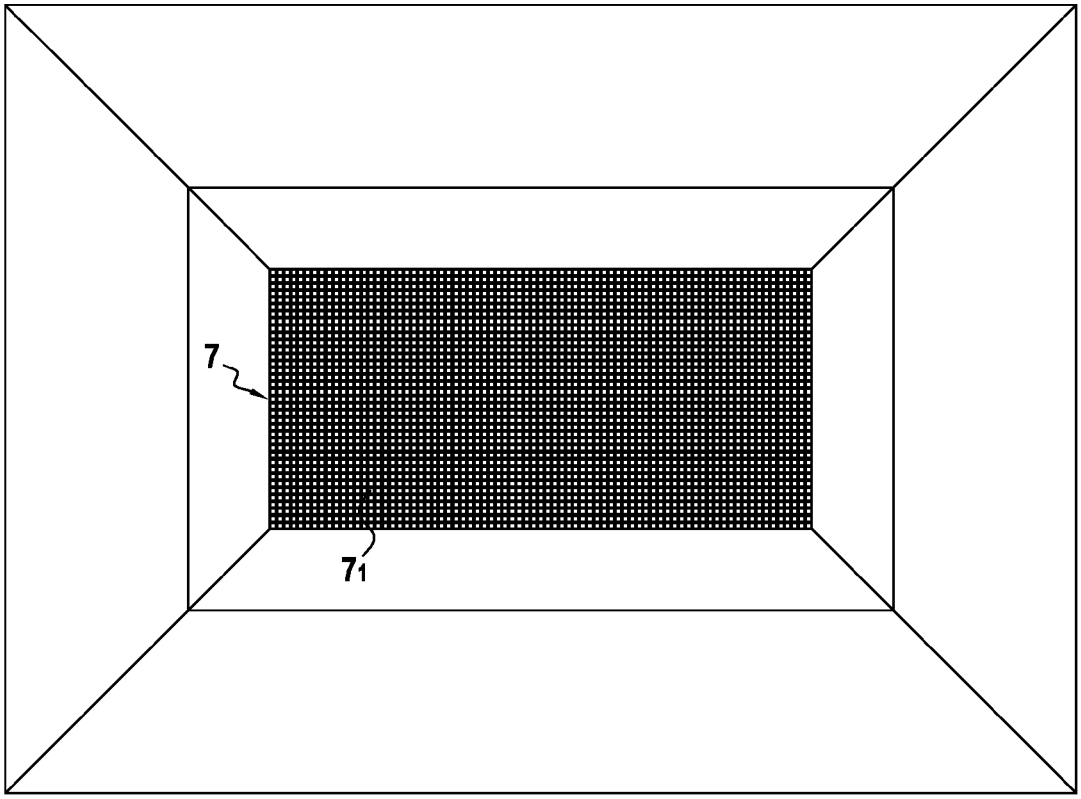
FIG. 6 is an overhead view of a filtration grid 6.

Underneath the break-up means via ultrasound generation 5, a filtration grid 7 is arranged as illustrated in FIG. 6 of smaller mesh size $7_1$ intended to collect pieces of waste or various objects initially contained in the collected snow and that can be periodically evacuated from the grid by a scraper 7*a* actuated by a hydraulic cylinder 7*b* towards outside the reservoir 1 which comprises an evacuation hatch (not illustrated) in the direction of the associated storage basin 11. The grid 7 particularly retains any metallic or mineral elements such as stones contained in the snow.

It is advantageous to arrange this grid 7 underneath the fluidisation means 2-6 of the first reservoir since if this grid 7 were to be arranged in the upper part its smaller mesh size $7_1$ could prevent the passing of non-fluidised snow through the filtering grid.

The open lower end 1*e* of the lower part 1*d* of the reservoir arranged below the grid 7 is funnel-shaped to accompany the reducing of snow volume in fluidised form. The lower end 1*e* communicates with means 8 to evacuate fluidised snow. These evacuation means 8 comprise a transfer pump 9*ab* and conduit 9 optionally completed by a motorised worm screw 8*a* or Archimedes screw inside a cylindrical nozzle 8*c* actuated by a motor 8*b* to push the fluidised snow inside the first transfer conduit 9 assisted by the circulation pump 9*a* thereby feeding the storage basin 11 and setting up closed loop circulation between the first reservoir and the storage basin.

The storage basin 11 can be equipped with a third transfer conduit 13 transferring water from its bottom part 11*a*, assisted by a circulation pump 14 integrating water filtration means, towards a water supply network 15.

The third transfer conduit 15 may also allow evacuation of water 12 stored in the storage basin 11 towards a secondary storage point such as a lake, river or other.

Conducted tests provided the demonstration that the ultrasound waves have an effect on snow fluidisation without the need to apply heat under the following conditions. The ultrasound waves have the effect of initially reducing the volume of snow when the snow retracts and of fluidising the snow to obtain a mixture easily transferable by conventional pump and conduits.

This effect is improved by 30% in terms of rapidity if the volume of snow mass is initially reduced by 30% via compacting.

For a large-size international airport, the amount of snow to be evacuated with a coverage thickness of 10 cm would be 200,000 to 600,000 m3 with weight varying between 200 and 500 kg/m3; the equivalent amount of water to be evacuated is therefore 22,000 to 300,000 m3.

The invention claimed is:

1. A snow volume-reducing and fluidisation device comprising:

a first fixed reservoir equipped with a fluidizer configured to fluidise and reduce the volume of snow;

at least one second reservoir forming a storage basin of larger volume than the first reservoir, the volume of said storage basin being at least 20 times the volume of the first reservoir, and said storage basin being at least partly filled with water, said water being at ambient temperature;

at least one first fluid transfer conduit between an evacuation orifice at the lower end of said first reservoir and said storage basin, said evacuation orifice enabling evacuation of a fluidised snow mixture in a lower part of the first reservoir; and at least one second transfer conduit between said storage basin and said first reservoir;

said fluidizer comprising:

a snow compactor comprising a mobile dynamic compactor; and a mechanical snow breaker comprising a chopper and/or a mixer arranged below said snow compactor, said mechanical snow breaker being configured to force the snow to move downwards; and at least one water injector inside and/or above the first reservoir and supplied with water from the storage basin via said second transfer conduit, said water injector being positioned at least above said chopper and/or mixer; and an ultrasound generator comprising ultrasound emitters supported by a rigid structure inside the first reservoir, arranged below said chopper and/or mixer and below said water injector.

2. The device according to claim 1 wherein said first reservoir is partly pre-filled with water in a lower part of the first reservoir as far as above said ultrasound emitters and below said mechanical snow breaker.

3. The device according to claim 1 wherein said rigid structure is a lattice structure defining orifices allowing the passing of fluidised snow and flowing of the snow downwards in the first reservoir, said rigid structure extending over substantially entirely a horizontal cross-section of the first reservoir and supporting a plurality of said ultrasound emitters distributed at several points.

4. The device according to claim 1 wherein said ultrasound emitters are in the form of cylindrical bars secured on top of solid parts of said rigid structure and distributed over said rigid structure so that said ultrasounds are diffused in substantially homogeneous manner over the entire cross section of said first reservoir, at least in a lower part of the first reservoir.

5. The device according to claim 1 wherein said mobile dynamic compactor comprise an assembly of pivoting plates, the assembly of said pivoting plates substantially covering an entire surface of a horizontal cross-section of said first reservoir above said chopper and/or mixer, said pivoting plates being secured to side walls of the first reservoir, said pivoting plates being hinged in rotation relative to said side walls of said first reservoir on a horizontal rotation shaft.

6. The device according to claim 1 wherein the first reservoir further comprises a filter for filtering solid objects contained in the snow, arranged upstream of said evacuation orifice and downstream of said ultrasound generator.

7. The device according to claim 1 wherein the first reservoir further comprises static compactor consisting in that the first reservoir has:

a height that is of larger dimension than width thereof; and side walls comprising a funnel-forming part forming a funnel of smaller horizontal cross section than an upper opening thereof, said funnel-forming part being arranged at least below said chopper and/or mixer.

8. The device according to claim 1 wherein said mechanical snow breaker comprises toothed rotating discs and/or fingers in the form of angled blades mounted on at least a horizontal transverse shaft or drum, configured to break up and force downwards pieces of ice and/or compacted snow.

9. The device according to claim 1 wherein said first reservoir comprises or cooperates with aid dynamic snow evacuator to evacuate a fluidised snow at a lower end of the first reservoir, downstream of said evacuation orifice and below said ultrasound generator.

10. The device according to claim 1 wherein the reservoir further comprises first means to transfer fluidised snow comprising the first transfer conduit and a first pump to circulate a mixture obtained from said first reservoir towards a said storage basin, and second means to transfer water between the storage basin and water injector inside the first reservoir, comprising a second transfer conduit and a second fluid circulation pump.

11. The device according to claim 1 wherein the first reservoir is an open-top tank having a lower part of side walls buried in the ground.

12. The device according to claim 1 wherein said first reservoir is arranged on a truck or trailer.

13. The device according to claim 1 wherein said storage basin is an open storage basin having at least a lower part of side walls buried in the ground.

14. A site snow-clearing method using a device according to claim 1 wherein the following steps are carried out comprising:

tipping snow into the first reservoir;

actuating said chopper and/or mixer, said water injector, said dynamic compactor and said ultrasound generator; and evacuating fluidised snow from said evacuation orifice towards said storage basin.

15. The method according to claim 14 wherein said first reservoir and said storage basin are partly pre-filled with water, and water circulates in a closed circuit between said storage basin and said first reservoir, said storage basin comprising or cooperating with water filter and conducts and pumps allowing stored water to be transferred to a water supply network or into an environment.

16. The device according to claim 5 wherein said pivoting plates are open plates or first pivoting grids.

17. The device according to claim 5 wherein pivoting of said pivoting plates is assisted by hydraulic actuators.

18. The device according to claim 6 wherein the first reservoir further comprises evacuator to evacuate said objects out of said first reservoir, said evacuator being of scraper type actuated by a cylindric actuator or Archimedes screw.

19. The device according to claim 8 wherein said toothed rotating discs and/or fingers are mounted on a plurality of parallel shafts or drums so as substantially to cover an entire horizontal cross-section of said first reservoir.

20. The device according to claim 9 wherein said dynamic snow evacuator comprises a transfer pump and/or motorized worm screw.

* * * * *